US008997383B2

(12) United States Patent
Itou et al.

(10) Patent No.: US 8,997,383 B2
(45) **Date of Patent: *Apr. 7, 2015**

(54) CONSTRUCTION-EQUIPMENT BUCKET-TOOTH ASSEMBLY AND BUCKET PROVIDED TO SAME

(75) Inventors: Daijirou Itou, Hirakata (JP); Takanori Nagata, Dallas, TX (US); Eiji Amada, Kyotanabe (JP); Tsuyoshi Yoshida, Tokyo (JP)

(73) Assignee: Komatsu Ltd., Tokyo (JP)

( * ) Notice: Subject to any disclaimer, the term of this patent is extended or adjusted under 35 U.S.C. 154(b) by 207 days.

This patent is subject to a terminal disclaimer.

(21) Appl. No.: 13/818,770

(22) PCT Filed: Apr. 26, 2012

(86) PCT No.: PCT/JP2012/061260

§ 371 (c)(1),
(2), (4) Date: Feb. 25, 2013

(87) PCT Pub. No.: WO2012/153651

PCT Pub. Date: Nov. 15, 2012

(65) Prior Publication Data

US 2013/0152433 A1 Jun. 20, 2013

(30) Foreign Application Priority Data

May 9, 2011 (JP) ..... 2011-104555

(51) Int. Cl.
*E02F 9/28* (2006.01)

(52) U.S. Cl.
CPC ..... *E02F 9/2833* (2013.01); *E02F 9/2841* (2013.01); *E02F 9/2891* (2013.01)

(58) Field of Classification Search
CPC ..... E02F 9/2825; E02F 9/2833; E02F 9/2858; E02F 9/2841; E02F 9/2816; E02F 9/2891; F16B 21/02
USPC ..... 37/446, 450–456
See application file for complete search history.

(56) References Cited

U.S. PATENT DOCUMENTS 5,718,070 A * 2/1998 Ruvang ..... 37/459
5,913,605 A * 6/1999 Jusselin et al. ..... 37/451

(Continued)

FOREIGN PATENT DOCUMENTS

JP 2000-104293 A 4/2000
JP 2009-013788 A 1/2009

(Continued)

OTHER PUBLICATIONS

International Search Report of corresponding PCT Application No. PCT/JP2012/061260.

*Primary Examiner* — Matthew D Troutman
(74) *Attorney, Agent, or Firm* — Global IP Counselors, LLP

(57) ABSTRACT

A bucket tooth assembly is mounted to an adapter provided to a distal end part of a bucket of construction equipment. The bucket assembly includes a bucket tooth and a latching member. The bucket tooth has a cavity for inserting the adapter and a through-hole that is provided to the side face and communicates through to the adapter when the bucket tooth has been mounted to the adapter. The through-hole has a center axis. The latching member is fitted inside the through-hole and having a rotational axis disposed along a direction of the center axis and a bottom part provided to an end on an adapter side in an axial direction. The latching member is rotated to switch between a first state in which the bottom part is held inside the through-hole and a second state in which the bottom part protrudes toward a concave portion on the adapter side.

7 Claims, 6 Drawing Sheets

(56) References Cited

U.S. PATENT DOCUMENTS

| | | | | |
|---|---|---|---|---|
| 7,762,015 | B2 | 7/2010 | Smith et al. | |
| 8,832,975 | B2 * | 9/2014 | Itou et al. | 37/455 |
| 2004/0237354 | A1 | 12/2004 | Emrich | |
| 2007/0000157 | A1 | 1/2007 | Emrich | |
| 2009/0174252 | A1 | 7/2009 | Morris et al. | |
| 2011/0099861 | A1 | 5/2011 | Ollinger, IV et al. | |
| 2012/0186113 | A1 * | 7/2012 | Harder et al. | 37/455 |

FOREIGN PATENT DOCUMENTS

| | | | |
|---|---|---|---|
| JP | 2010-526953 | A | 8/2010 |
| JP | 2011-511180 | A | 4/2011 |

* cited by examiner (a)

(b)

(a)

(b)

CONSTRUCTION-EQUIPMENT BUCKET-TOOTH ASSEMBLY AND BUCKET PROVIDED TO SAME

CROSS-REFERENCE TO RELATED APPLICATIONS

This application claims priority to Japanese Patent Application No. 2011-104555 filed on May 9, 2011, the disclosure of which is hereby incorporated herein by reference in its entirety.

FIELD OF THE INVENTION

The present invention relates to a bucket tooth assembly that is mounted interchangeably at the distal end portion of the lower face of a bucket on a piece of construction equipment (hereinafter referred to as a tooth assembly), and to a bucket on which these bucket tooth assemblies are mounted.

DESCRIPTION OF THE RELATED ART

Various kinds of excavation tool are attached to a work implement installed on a hydraulic excavator or other such work vehicle. For example, a plurality of teeth (excavation tools) are attached to the excavation-side distal end portion of a bucket (work implement) installed on a hydraulic excavator, so that the teeth protrude from the distal end portion. During excavation, these teeth function as cutting blades, which improves the excavation performance by biting into what is being excavated.

Because the teeth attached to the distal end portion on the excavation side of the bucket are pushed into the excavated material during excavation work, they wear down much faster than other parts. Therefore, the teeth are attached interchangeably to the bucket, and are replaced as needed, such as after about 1000 hours of excavation work. That is, because the teeth are replaced frequently, the work entailed by this replacement needs to be easy.

U.S. Pat. No. 7,762,015 discloses a structure in which such teeth are combined with attachment members into tooth assemblies, which are attached to an adapter on the bucket.

More specifically, with the tooth assembly attachment structure disclosed in the above-mentioned publication, a protrusion (bar) provided to the side end on the adapter side is inserted into a groove provided on the tooth assembly side, and a C-shaped locking member is rotated to fix the tooth assembly with respect to the adapter.

SUMMARY

However, the following problems were encountered with the above-mentioned conventional tooth assembly attachment structure.

Specifically, with the tooth assembly attachment structure disclosed in the above-mentioned publication, the tooth assemblies are fixed using protrusions (bars) provided on the adapter side. Therefore, when a heavy load is exerted on the teeth during work, etc, the protrusions are susceptible to deformation and damage, and this can shorten the service life of parts including the adapter. In this case, since the protrusions (that is, the adapter) cannot be replaced (unlike the tooth assemblies), a time-consuming repair is necessary.

Also, a groove is provided to the tooth assembly at the place that corresponds to the path of the protrusion when the tooth assembly is mated with the adapter, but if this place is made as thick as other places in order to ensure good strength, the dimension in the width direction (the direction in which the protrusion sticks out) ends up being too large. When the teeth are thus made wider than usual, there is less spacing between the teeth, and this can lead to greater difficulty in attaching and removing the teeth.

It is an object of the present invention to provide a piece of construction equipment bucket tooth assembly with which tooth replacement is easier and bucket teeth can be fixed to an adapter by a simple configuration, as well as a piece of construction equipment bucket comprising this bucket tooth assembly.

The construction equipment bucket tooth assembly pertaining to the first aspect is interchangeably mounted to an adapter provided to the distal end part of a piece of construction equipment bucket, and comprises a bucket tooth and a latching member. The bucket tooth has a cavity, a contact face, a side face, and a through-hole. The cavity is provided for inserting the adapter. The contact face is inside the cavity and comes into contact with the outer face of the adapter so as to receive a load exerted during work. The side face has a triangular shape on the outer face of the tooth. The through-hole is provided to the side face and has a center axis that communicates through to the adapter when the tooth has been mounted to the adapter. The latching member is fitted inside the through-hole and has a rotational axis disposed along the center axis direction and a bottom part provided to the end on the adapter side in the axial direction, and is rotated around the rotational axis to switch between a first state in which the bottom part is held inside the through-hole and a second state in which the bottom part protrudes toward a concave portion on the adapter side.

Here, with a bucket tooth assembly that can be interchangeably mounted to an adapter provided to the distal end portion of the bucket of a hydraulic excavator or other such construction equipment, the load exerted on the bucket teeth during work is borne by the contact faces of the bucket teeth, and when the bucket teeth are subjected to a force in the direction of knocking them off of the adapter, the bucket teeth are latched on the adapter side by using latching members inserted into through-holes formed in the bucket teeth. These latching members are rotated around the rotational axes to switch between states in which the bucket teeth are latched and unlatched to and from the adapter.

The above-mentioned load exerted during work includes, for example, a load produced in excavation work using bucket teeth attached to a bucket. That is, the structure is such that a heavy load in the direction of pushing the bucket teeth into the adapter during such work is received by the faces where the adapter and the bucket teeth come into contact with each other, and the latching members are subjected to almost no load during work.

Conversely, when the bucket tooth assemblies are subjected to a force that would move them away from the adapter, such as gravity, the bucket tooth assemblies can be prevented by the latching members from falling off the adapter.

The above-mentioned latching members include, for example, those whose external shape is conical or cylindrical, and those having a substantially trapezoidal cross section in which the upper part of a cone has been cut off.

Consequently, because the heavy load exerted on the bucket teeth during work is borne by the contact faces, the latching member are not subjected to a heavy load. Also, since concave portions in which the bottom parts of the latching members are latched are formed on the adapter side, there is no damage or the like on the adapter side. Furthermore, the bucket tooth assemblies can be easily switched between a latched state and an unlatched state by rotating the latching members around the rotational axes.

As a result, a bucket tooth assembly can be obtained which can be easily attached to or removed from the adapter and with which a decrease in the service life of parts including the adapter can be avoided, and this can be accomplished with a simple configuration.

The construction equipment bucket tooth assembly pertaining to the second aspect is the construction equipment bucket tooth assembly pertaining to the first aspect, wherein the latching member is such that the length of the side face portion is in left and right asymmetry in a cross sectional view along the rotational axis.

Here, the latching member used for latching the bucket tooth to the adapter has a shape such that the length of the side faces is in left and right asymmetry in a cross sectional view along the rotational axis.

Consequently, the bottom part of the latching member can be made to protrude from or retract into the through-hole merely by rotating the late ling member around the rotational axis. As a result, the bucket tooth assembly can be easily switched between a latched state and an unlatched state by an operation that merely involves rotating the latching member.

The construction equipment bucket tooth assembly pertaining to the third aspect is the construction equipment bucket tooth assembly pertaining to the second aspect, wherein the latching member has the shape of part of a truncated cone formed by the rotational axis, and the shape of the part of truncated cone is such that a cut face, obtained by cutting diagonally to the rotational axis from above the periphery of the bottom face of the truncated cone, corresponds to the bottom part of the latching member.

Here, the above-mentioned latching member is a member having a shape in which part of a truncated cone has been cut off.

Consequently, the latching member can be prevented from falling off the tooth in a state in which the tooth has been mounted to the adapter. Also, because of this simple configuration, the tooth can be easily switched between a latched state and an unlatched state merely by rotating.

The construction equipment bucket tooth assembly pertaining to the fourth aspect is the construction equipment bucket tooth assembly pertaining to the third aspect, wherein the bucket tooth has an inner face that forms the cavity, and the bottom part of the latching member lies in the same plane as the inner face in the first state.

The bucket tooth assembly can be easily attached to or removed from the adapter merely by rotating the latching member to the first state.

The construction equipment bucket tooth assembly pertaining to the fifth aspect is the construction equipment tooth assembly pertaining to any of the first to fourth aspects, wherein the rotational axis of the latching member is disposed inclined toward the distal end of the bucket tooth from the cavity outward along the width direction of the bucket tooth.

Here, the rotational axis of the latching member that is rotated in a state of having been inserted into the through-hole of the bucket tooth assembly is disposed inclined diagonally away from the adapter from the cavity side.

Consequently, the bottom part of the latching member can be made to protrude from or retract into the through-hole merely by rotating the latching member around the rotational axis. As a result, the bucket tooth assembly can be easily switched between a latched state and an unlatched state by an operation that merely involves rotating the latching member.

The construction equipment bucket tooth assembly pertaining to the sixth aspect is the construction equipment bucket tooth assembly pertaining to any of the first to fifth aspects, wherein the latching member has a tool insertion portion, into which is inserted part of a tool used when the latching member is rotated around the rotational axis, at a position that is exposed to the outside in a state in which the latching member has been inserted into the through-hole.

Here, the tool insertion portion into which is inserted a tool used in rotating the latching member is provided on the side that is exposed to the outside of the latching member inserted into the through-hole of the bucket tooth assembly.

Consequently, the latching member can be easily rotated by inserting a tool from the outside of the through-hole.

The construction equipment bucket tooth assembly pertaining to the seventh aspect is the construction equipment bucket tooth assembly pertaining to any of the first to sixth aspects, further comprising an anti-rotation member that stops rotation of the latching member.

Here, the anti-rotation member is provided to keep the latching member, which switches the bucket tooth assembly between a latched state and an unlatched state by rotating around the rotational axis, from rotating unintentionally.

The anti-rotation member here includes a C-ring member that mates with the outer peripheral face of the latching member, a bolt member that is fitted into the latching member, and the like.

Consequently, the latching member can be prevented from rotating under vibration or the like produced during work using the bucket, for example. As a result, the bucket tooth assembly can be effectively prevented from falling off the adapter due to unintentional rotation of the latching member.

The construction equipment bucket pertaining to the eighth aspect is a piece of construction equipment bucket to the distal end part of which are mounted bucket tooth assemblies, said bucket comprising adapters provided to the distal end part, bucket tooth assemblies that are mounted to the adapter and each have a through-hole that is formed in the side face and passes through to the adapter, and a latching member is inserted into the through-hole and allows switching by rotation between a first state in which a bottom part is held inside the through-hole and a second state in which the bottom part protrudes from the through-hole, and concave portions that are provided to the adapters at positions corresponding to the through-holes of the bucket tooth assemblies, that form truncated conical spaces along with the through-holes, that have a face corresponding to the curved face of the truncated cone at the distal end side of the bucket tooth assembly and a face corresponding to the bottom face on the large-diameter side of the truncated cone at the rear end side of the bucket tooth assembly, and in which the bucket tooth assemblies are latched to the bucket by fitting in the latching members in the second state.

Consequently, since the concave portions corresponding to the latching members of the bucket tooth assemblies in the above-mentioned second state are provided on the adapter side, the bucket tooth assemblies can be mounted more easily.

DESCRIPTION OF THE EMBODIMENTS

First Embodiment

A tooth 2 (construction equipment bucket tooth assembly) pertaining to an embodiment of the present invention, and the attachment structure thereof will be described through reference to FIGS. 1 to 4*b*.

Figure 1:
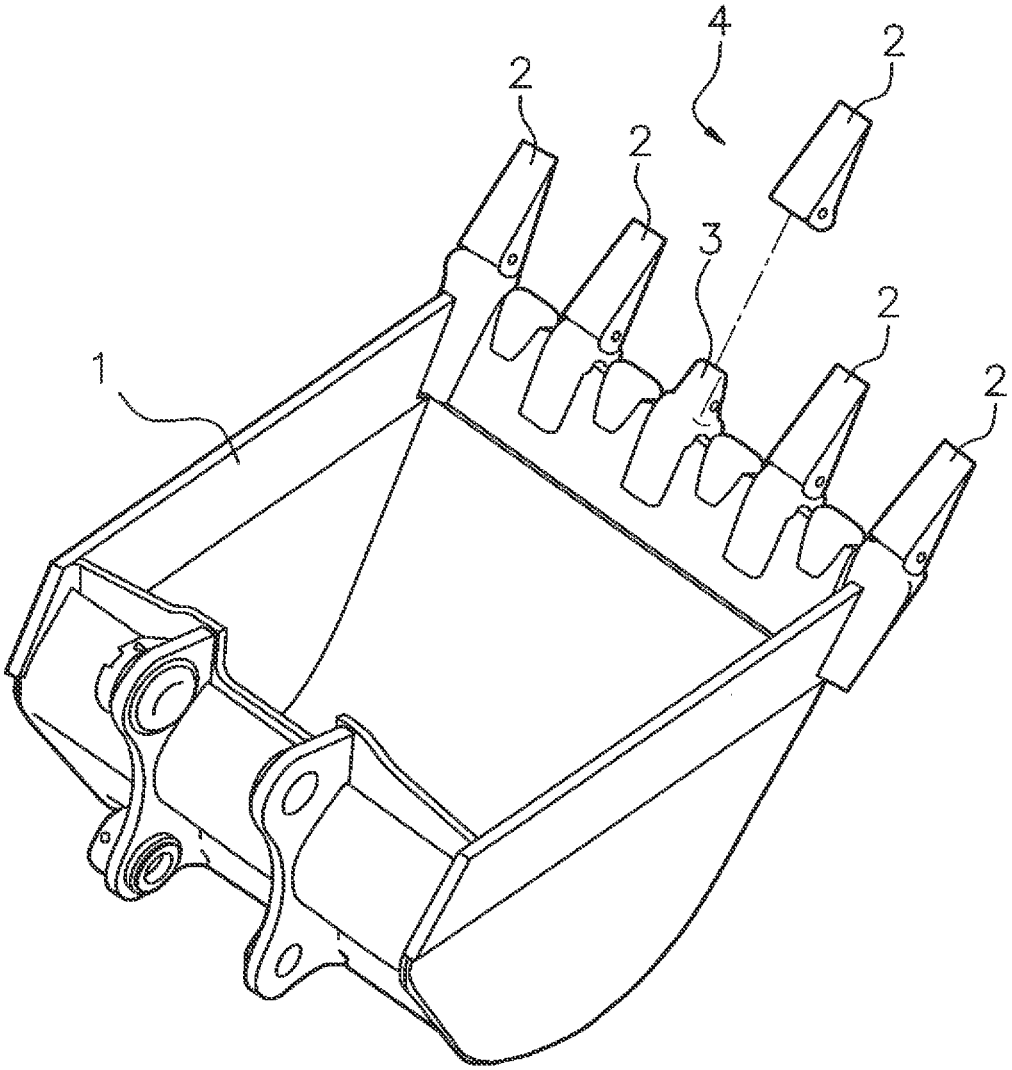
FIG. 1 is an oblique view of an attachment structure for a bucket tooth assembly used on a piece of construction equipment and pertaining to an embodiment of the present invention.

As shown in FIG. 1, the teeth 2 (construction equipment bucket tooth assemblies) of a bucket 1 pertaining to this embodiment are attached to a plurality of adapters 3 provided to the distal end (the upper-right end in FIG. 1) of the lower face (the excavation side) of the bucket 1. These teeth 2 are replaced when they are worn down by work.

In this embodiment, a bucket tooth assembly corresponds to a tooth 2, and is an assembled part in which a latching member 4 is mounted to a main body part 2*a* (discussed below), and can be attached directly to the adapters 3 of the bucket 1.

Teeth 2

Figure 2:
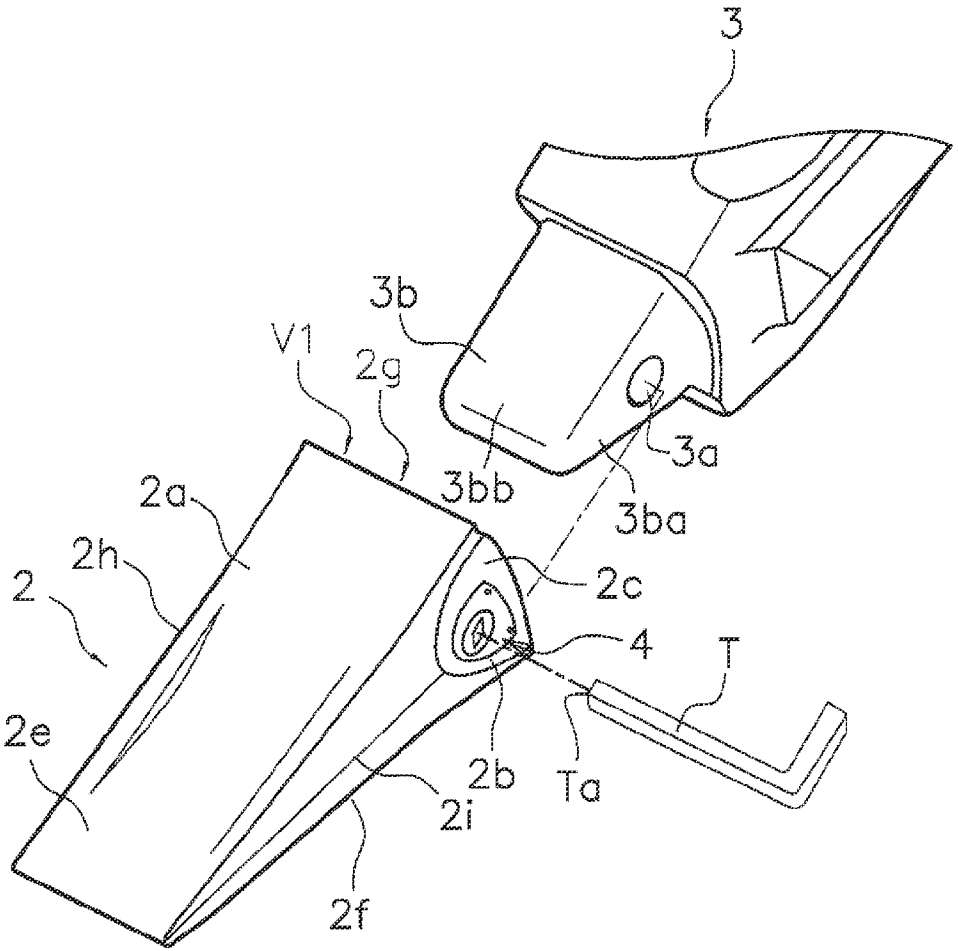
FIG. 2 is an exploded oblique view showing in detail the attachment portion of the bucket tooth assembly in FIG. 1.
Figure 3:
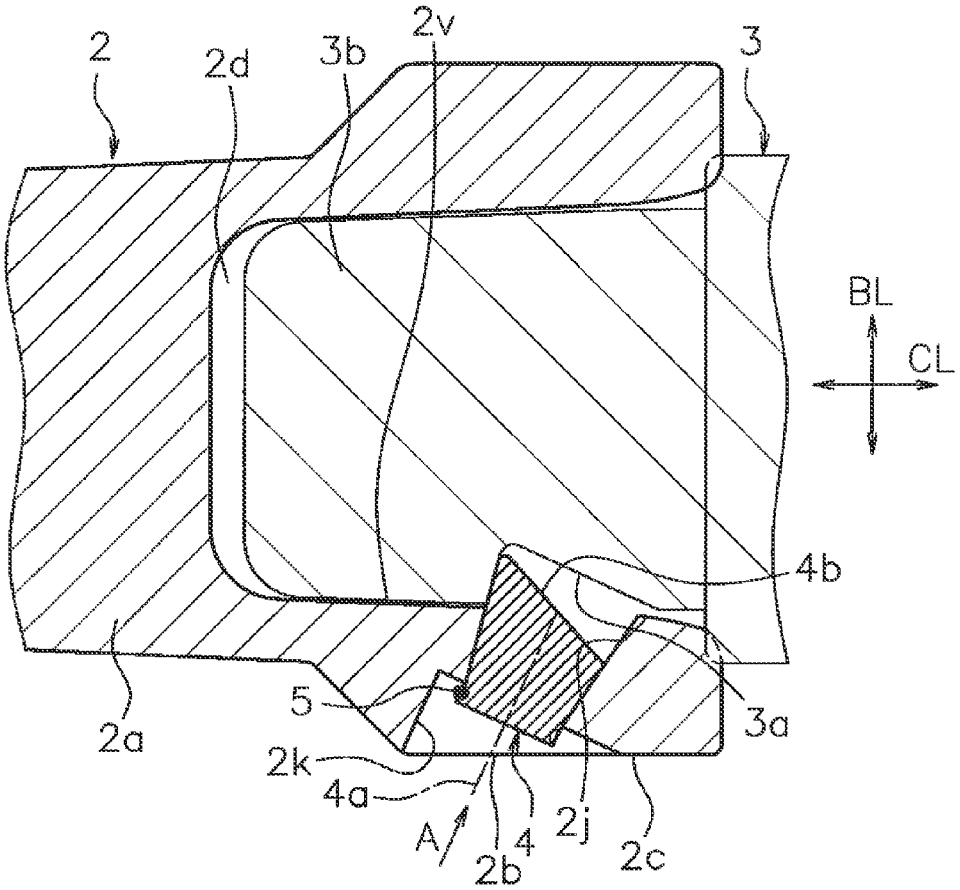
FIG. 3(*a*) is a detail cross section of the joined portion of an adapter and a bucket tooth assembly, and FIG. 3(*b*) is a plan view of the latching member in FIG. 3(*a*) as seen in the axial direction.
Figure 3:
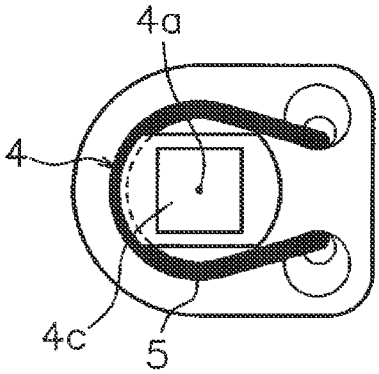
Figure 4:
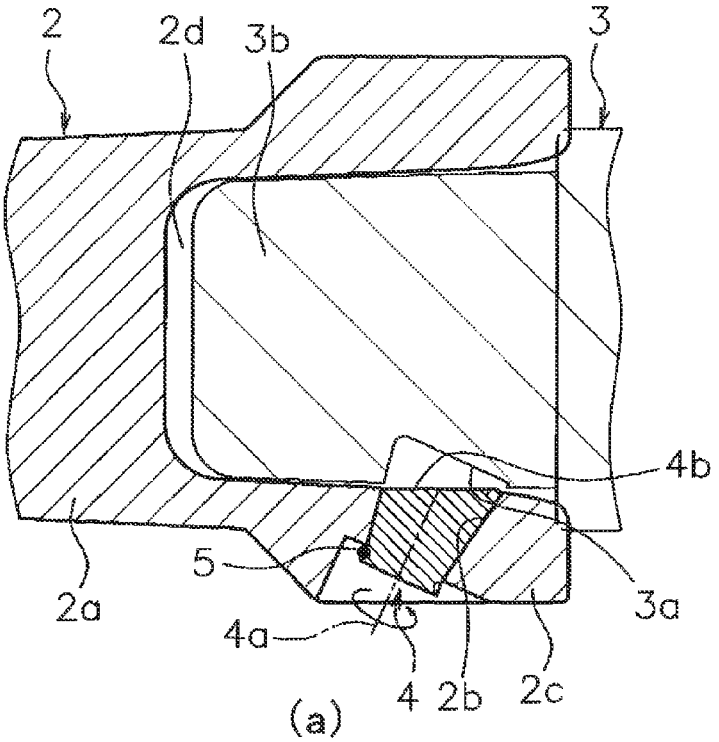
FIGS. 4(*a*) and 4(*b*) are detail cross sections showing the switching between a latched state and an unlatched state by rotating the latching member provided to the joined portion of an adapter and a bucket tooth assembly.
Figure 4:
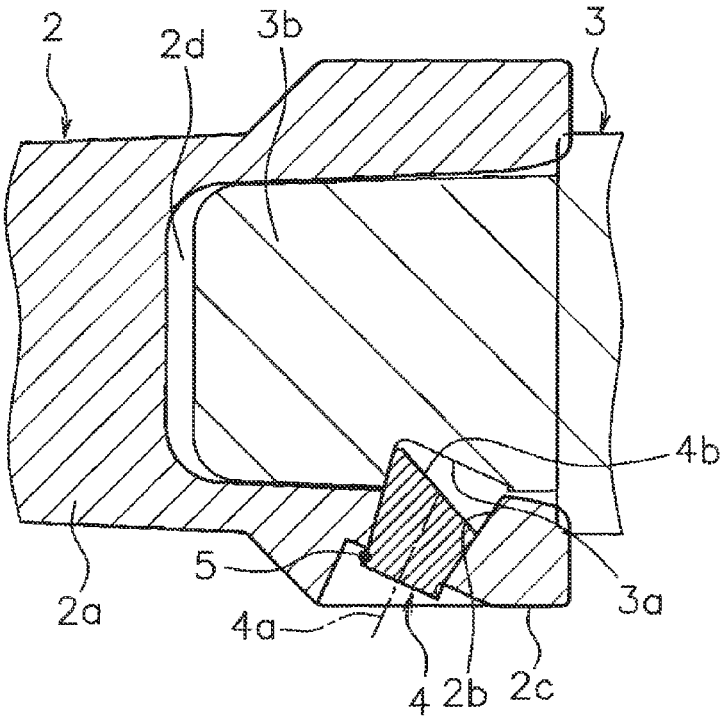

As shown in FIG. 2, the tooth 2 is a prong-like member attached to the distal end of the excavation portion of the bucket 1 in order to perform excavation with the bucket 1, and has a wedge-like outer shape that tapers toward the distal end. As shown in FIG. 2, the tooth 2 has the main body part (bucket tooth) 2*a*, a through-hole 2*b*, a side wall 2*c*, a contact face 2*d* (see FIG. 3*a*), and a cavity V1.

The main body part 2*a* has outer faces made up of an upper face 2*e* and lower face 2*f* that are substantially rectangular and are linked at their distal ends, substantially triangular side faces 2*h* and 2*i* in between the upper face 2*e* and the lower face 2*f*, and a substantially rectangular rear end face 2*g*. The rear end face 2*g* has an opening and continues to the cavity V1. The cavity V1 is formed by an inner face 2*v* that is on the inside of the main body part 2*a*.

The cavity V1 is a concave space formed in the interior of the main body part 2*a* from the rear end face 2*g* of the tooth 2 toward the distal end. This concave space is shaped like a wedge, tapering toward the distal end just as the tooth 2 does. An insertion portion 3*b* of the adapter 3 (discussed below) is inserted into this cavity V1.

The side wall 2*c* forms the side faces of the cavity V1 formed in the interior of the main body part 2*a* by projections on the rear end side of the side faces 2*h* and 2*i*, and the through-hole 2*b* (discussed below) is formed on one side (the side face 2*i*).

The through-hole 2*b* has an opening 2*k* that is provided to the side wall 2*c* and opens to the outside, and an insertion portion 2*j* that is smaller in diameter than this opening 2*k* and into which the latching member 4 is inserted (discussed below). The through-hole 2*b* goes from the side face 2*i* on one side of the main body part 2*a* into the cavity V1, and is formed inclined in the width direction of the tooth 2 (the BL direction in FIG. 3*a*) from the cavity V1 side outward toward the distal end of the tooth 2. The latching member 4 (discussed below) is inserted into the through-hole 2*b*. The insertion portion 2*j* that mates with the inserted latching member 4 is a space having the shape of part of a truncated cone that is a cylindrical body. The small diameter side of this space is on the side wall 2*c* side of the tooth 2, and the large diameter side is on the cavity V1 side. The rotational axis of the truncated cone going from the large diameter side to the small diameter side (the center axis of the side face 2*i* of the through-hole 2*b*; hereinafter referred to as the center axis of the through-hole 2*b*) is disposed so as to be inclined toward the distal end of the tooth 2 from the width direction of the tooth 2 (the BL direction FIG. 3*a*). The through-hole 2*b* has an inside diameter that is larger by a play amount at the corresponding location than the outside diameter of the latching member 4 (discussed below). The shape of the remaining portion besides the above-mentioned truncated conical insertion portion 2*j* shall be considered to be the shape of the rest of the truncated cone.

The contact face 2*d* is pant of the inner face 2*v*, is an inner wall face disposed in a V shape that forms the cavity V1 inside the main body part 2*a*, and comes into contact with a contact face 3*bb* on the adapter 3 side (discussed below). Here, a state in which the contact face 2*d* of the tooth 2 is in contact with the contact face 3*bb* of the adapter 3 is a state in which the adapter 3 has been inserted as far as it will go into the tooth 2.

Adapter 3

As shown in FIG. 1, a plurality of the adapters 3 are provided to the lower face end of the bucket 1, and the above-mentioned teeth 2 are attached to these adapters. As shown in FIG. 2, the adapter 3 has a concave portion 3*a* and the insertion portion 3*b*.

The concave portion 3*a* is a bottomed groove, and is formed on one side face (the side wall 3*ba*) of the insertion portion 3*b* of the adapter 3. This concave portion 3*a* has the shape of the rest of the truncated cone, and when the tooth 2 is grated in a contact state with the adapter 3, a single completed space is formed in a substantially truncated conical shape, which communicates with (the insertion portion 2*j*) of the substantially truncated conical space of the through-hole 2*b* of the tooth 2. The bottom of the concave portion 3*a* is the bottom face on the large diameter side of the substantially truncated conical space thus completed, and the part of the bottom of the concave portion 3*a* that is farthest to the rear end side is substantially located on the side wall 3*ba* of the adapter 3. Therefore, the concave portion 3*a* is made up of a face having the curved face of an approximate truncated cone on the distal end side of the tooth 2, and the flat face of an approximate truncated cone on the rear end side of the tooth 2. The latching member 4 inserted into the through-hole 2*b* is rotated to insert or retract part (the bottom part 4*b*) of the latching member 4.

In other words, a state in which the bottom part 4*b* of the latching member 4 is inserted into the concave portion 3*a* means a latched state of the tooth 2. Conversely, a state in which the bottom part 4*b* of the latching member 4 has been retracted from inside the concave portion 3*a* so that the entire latching member 4 is now housed inside the through-hole 2*b* means an unlatched state of the tooth 2.

The insertion portion 3*b* is formed to match the shape of the cavity V1 formed inside the tooth 2, and is inserted into the cavity V1 formed in the interior of the tooth 2. In a state in which tooth 2 has been mounted to the adapter 3, if a load is exerted on the tooth 2 during work or the like, the contact face 2*d* of the tooth 2 where the cavity V1 is formed comes into contact with the contact face 3*bb* of the insertion portion 3*b* on the adapter 3 side, and this load is borne by the adapter 3. Consequently, a load exerted on the tooth 2 during work or the like is not exerted on the latching member 4 (discussed below).

The contact face 3*bb* is an outer wall face of the insertion portion 3*b* that comes into contact with the contact face 2*d* on the tooth 2 side in a state in which the tooth 2 has been attached. As discussed above, the contact face 3*bb* receives a load exerted on the tooth 2 during work, at a face on the adapter 3 side.

Latching Member 4

The latching member 4 is a substantially truncated conical member that is attached so that the tooth 2 will not fall off the adapter 3. As shown in FIG. 2, the latching member 4 is inserted into the through-hole 2*b* on the tooth 2 side from the cavity V1 side. As shown in FIG. 3*a*, the latching member 4 has a latching member main body with a substantially truncated conical shape, a rotational axis 4*a* of this latching member main body (the rotational axis of the latching member), the bottom part 4*b*, and a tool insertion portion 4*c*.

The rotational axis 4*a* of the latching member 4 here is the same as the center axis of the through-hole 2*b* into which the latching member 4 is inserted, and the latching member 4 is able to rotate within the through-hole 2*b*.

As shown in FIG. 4*a*, the shape of the main body of the latching member 4 is the shape of the space on the through-hole 2*b* side of a truncated conical space obtained by cutting the completed truncated conical space formed by the through-hole 2*b* of the tooth 2 and the concave portion 3*a* of the adapter 3 in a contact state, at the face of the tooth 2 in which the cavity V1 is formed. In other words, the main body of the latching member 4 has a shape that is similar to that of the truncated conical space in the through-hole 2*b* of the tooth 2 but that is small enough to allow for play, and substantially has the shape of the above-mentioned part of a truncated cone. The rearmost position of the tooth 2 in a cross section is substantially equal to the rearmost position of the bottom part of the truncated conical space. The rotational axis 4*a* of the main body of the latching member is the same as the rotational axis of the truncated conical space formed by the through-hole 2*b* and the concave portion 3*a*.

The rotational axis 4*a* is the rotational center when the latching member 4 is rotated inside the through-hole 2*b* using a tool T (see FIG. 2).

As shown in FIG. 3*a*, the bottom part 4*b* is formed at an angle to the rotational axis 4*a* of the substantially truncated conical latching member 4, because of the different length of the outer peripheral face (generatrix) of the latching member 4 having a substantially truncated conical external shape in cross sectional view. As discussed above, the bottom part 4*b* of the latching member 4 at a specific rotational position is in the same plane as the inner face of the tooth 2 that forms the cavity V1. When the latching member 4 is rotated 180 degrees from this specific rotational position, the part of the latching member 4 that was at the rearmost location of the tooth 2 moves from the cavity face of the tooth 2 to a position on the distal end side of the tooth 2 of the bottom part of the concave portion 3*a*, and the adapter 3 engages with the latching member 4. Consequently, it is possible to switch between a state in which part (the bottom part 4*b*) of the latching member 4 is inserted into the concave portion 3*a* on the adapter 3 side (latched state) and a state in which it is retracted from inside the concave portion 3*a* (unlatched state) merely by rotating the latching member 4 around the rotational axis 4*a*.

The tool insertion portion 4*c* is provided to a face that is perpendicular to the rotational axis 4*a* at a location extended from the small diameter side of the substantially truncated conical shape on the latching member 4, and is disposed within the opening 2*k* of the through-hole 2*b*. This tool insertion portion 4*c* is a groove into which is inserted the distal end part Ta of the tool T (see FIG. 2) used to rotate the latching member 4 manually, and is formed in a shape that matches the shape of the distal end part Ta of the tool T (a square shape in FIG. 3*b*). A groove is provided to part of the outer periphery of the extended location, and a C-ring 5 (discussed below) is installed in this groove. FIG. 3*b* is a view of the area around the through-hole 2*b* from the viewpoint A in FIG. 3*a*.

In this embodiment, the C-ring 5 (anti-rotation member), which stops rotation of the latching member 4, is provided so that the latching member 4 will not unintentionally rotate due to vibration, impact, or the like during work with the construction equipment, except when the tool T is used to rotate the latching member 4 manually.

The C-ring 5 is a member formed in a U shape from rubber or another such elastic member, and is snugly fitted into the groove provided to the outer peripheral face of the latching member 4. The two ends of the C-ring 5 are fixed to the side wall 2*c*. The latching member 4 fits snugly against the C-ring 5, and this prevents rotation away from the specified position by friction.

Consequently, it is possible to prevent the latched state of the tooth 2 with respect to the adapter 3 from being released to the unlatched state as a result of the latching member 4 being unintentionally rotated by vibration or the like during work.

Switching of Tooth 2 Between Latched State and Unlatched State

In this embodiment, because of the configuration discussed above, the tooth 2 is switched between a latched state (second state) and an unlatched state (first state) with respect to the adapter 3.

Specifically as shown in FIG. 4*a*, when the tooth 2 is attached to the adapter 3, let us assume a state in which part (the bottom part 4*b*) of the latching member 4 inserted into the through-hole 2*b* of the tooth 2 has not moved into the concave portion 3*a* on the adapter 3 side, and is instead housed in the air through-hole 2*b* (unlatched state). If at this point this unlatched state does not exist in the attachment of the tooth 2, the tool T may be used to rotate the latching member 4 and create an unlatched state.

Consequently, the insertion portion 3*b* of the adapter 3 can be inserted into the interior of the cavity V1 in the tooth 2.

Next, in a state in which the insertion portion 3*b* of the adapter 3 has been inserted into the cavity V1 of the tooth 2, the tool T is used to rotate the latching member 4 180 degrees from the unlatched state, and as shown in FIG. 4*b*, this changes to a state in which part (the bottom part 4*b*) of the latching member 4 is has moved into the concave portion 3*a* on the adapter 3 side (latched state).

The bottom part 4*b* of the latching member 4 that has moved into the concave portion 3*a* on the adapter 3 side is such that when a force is exerted on the tooth 2 that moves it away from the adapter 3, part of the latching member 4 moving integrally with the tooth 2 is caught inside the concave portion 3*a* of the adapter 3. This creates a latched state in which the tooth 2 does not fall off the adapter 3.

Conversely, when a force is exerted (such as during excavation) in the direction of pushing the tooth 2 to the adapter 3 side (to the right, or the CL direction, in FIG. 3*a*), the heavy load exerted on the tooth 2 during work is borne by both the contact face 2*d* on the tooth 2 side and the contact face 3*bb* on the adapter 3 side, so the latching member 4 is not subjected to a load with this configuration. In this embodiment, the adapter 3 and the latching member 4 are in contact in the contact state between the tooth 2 and the adapter 3, but the load exerted on the tooth 2 is borne by the contact faces 2*d* and 3*bb*, and no load is exerted on the latching member 4. Also, even if wear of the contact faces 2*d* and 3*bb* should cause the tooth 2 to be pushed more to the rear end side beyond the pre-wear position, the latching member 4 will move away from the adapter 3 and will not be in contact with the adapter 3. Therefore, again, a load pushing the tooth 2 toward the adapter 3 is not exerted on the latching member 4. Thus, the latching member 4 only needs to have the function of latching the tooth 2 so that it does not fall off the adapter 3, so damage to the latching member 4 caused by load exerted on the tooth 2 during work can be prevented. As a result, a longer service life can be ensured for parts in the attachment structure portion of the tooth 2 while the tooth 2 can be switched between a latched state and an unlatched state by a simple configuration. Also, since the switching between latched state and unlatched state can be accomplished merely by rotating the latching member 4, the job of attaching and removing the tooth 2 to and from the adapter 3, that is, the job of replacing the tooth 2, can be performed more easily.

Second Embodiment

The teeth on a piece of construction equipment pertaining to another embodiment of the present invention will now be described through reference to FIGS. 5*a* and 5*b*.

Figure 5:
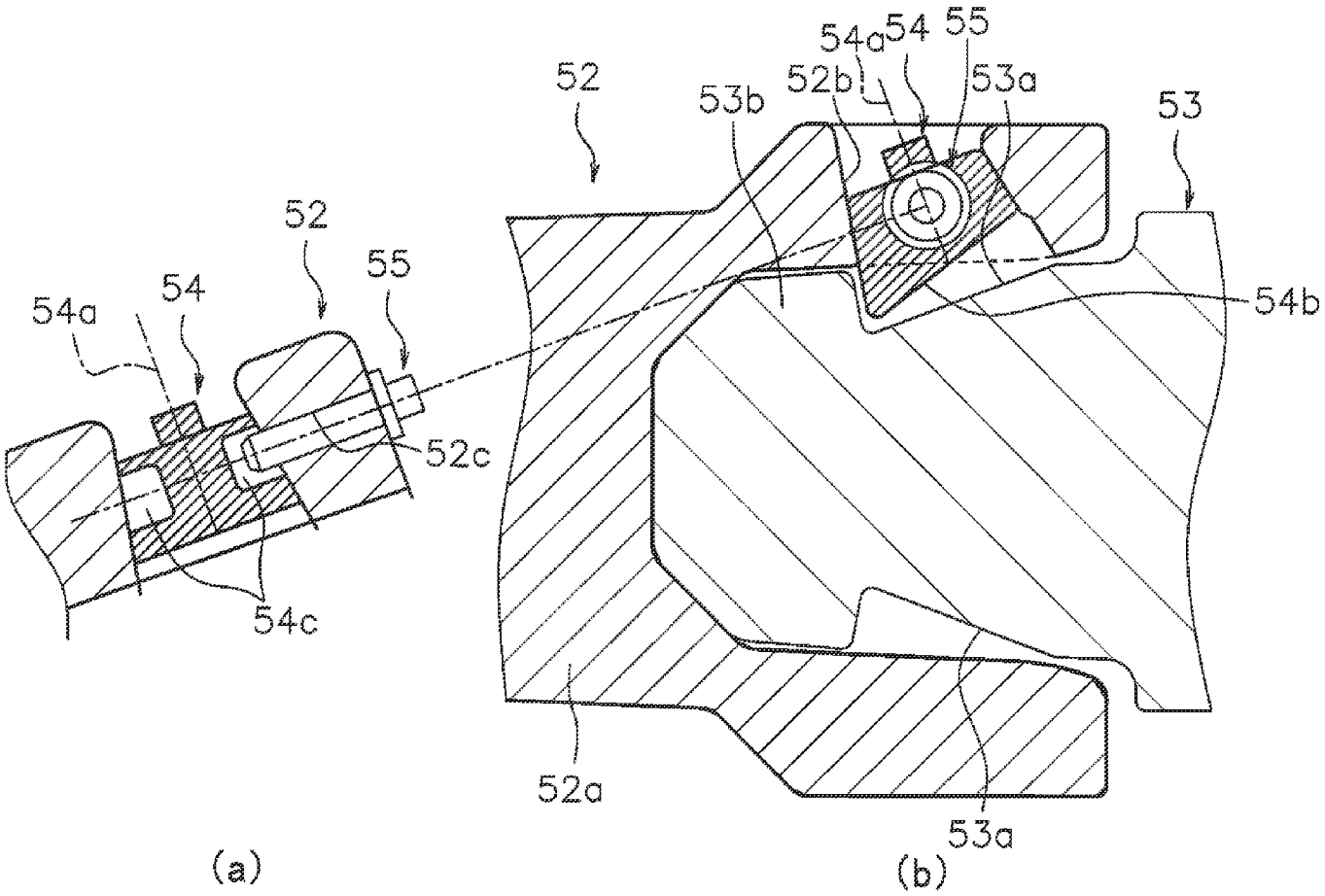
FIG. 5(*a*) is a detail cross section of the configuration around the latching member provided to the joined portion of an adapter and a bucket tooth assembly in another embodiment of the present invention, and FIG. 5(*b*) is a detail cross section of when the angle at which the latching member is viewed has been changed by 90 degrees.

This embodiment differs from the first embodiment above in that a bolt 55 (anti-rotation member) that stops rotation of a latching member 54, which rotates around a rotational axis 54*a* and in the outer peripheral face of which is formed a groove 54*c*, is used as shown in FIGS. 5*a* and 5*b* instead of using the C-ring 5 of the above embodiment as an anti-rotation member that stops rotation of the latching member 4.

As shown in FIG. 5*b*, in this embodiment the bottom part 54*b* of the member 54 can be moved in and out of a concave portion 53*a* of an adapter 53 by rotating the latching member 54 around the rotational axis 54*a* in a state in which an insertion portion 53*b* of the adapter 53 has been inserted into the interior of the main body part 52*a* of a tooth 52. The bolt 55 is then inserted into a bolt hole 52*c* formed in the side face of the main body part 52*a* in order to stop rotation of the latching member 54 in a state in which the main body part 52*a* of the tooth 52 has been latched to the adapter 53 by the latching member 54. If the bolt 55 is inserted all the way in, the distal end of the bolt 55 moves into the groove 54*c* formed in the outer peripheral face of the latching member 54. As shown in FIG. 5*a*, the groove 54*c* here is provided at two opposing places on the outer peripheral face of the latching member 54.

Consequently, the latching member 54 can be put in a state in which it cannot rotate around the rotational axis 54*a* by inserting the distal end of the bolt 55 into the groove 54*c*.

As shown in FIG. 5*b*, a concave portion 53*a* is preferably provided on the left and right side faces of the adapter 53.

As a result, no matter which side face of the main body part 52*a* of the tooth 52 the through-hole 52*b* is provided to, the tooth 52 can be latched to the adapter 53 by the latching member 54. Thus, teeth 52 with different shapes can be attached, and parts can be shared.

Other Embodiments

Embodiments of the present invention were described above, but the present invention is not limited to or by the above embodiments, and various modifications are possible without departing from the gist of the invention.

(A) In Embodiments 1 and 2 above, an example was given in which the state was switched between a latched state and an unlatched state by rotating the substantially truncated conical latching member 4, which had a large diameter part on the adapter 3 side (the insertion side), around the rotational axis 4*a*, but the present invention is not limited to this.

Figure 6:
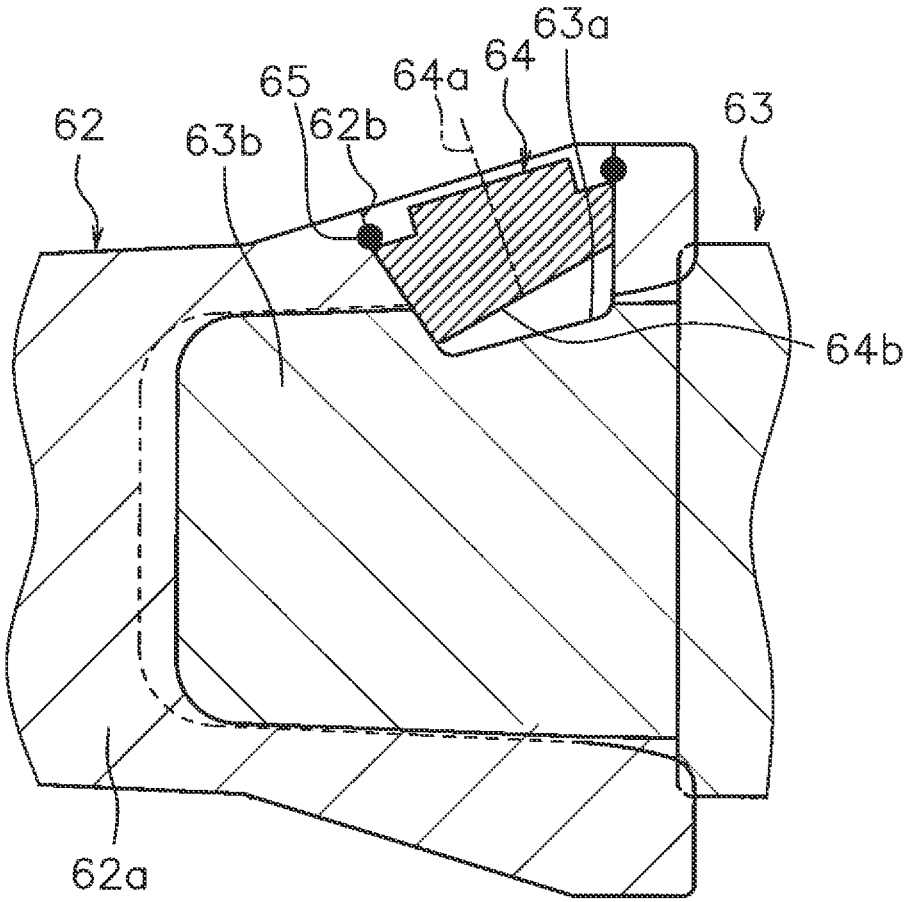
FIG. 6 is a detail cross section of the configuration the joined portion of a bucket tooth assembly of a piece of construction equipment in yet another embodiment of the present invention.

For example, even with the same substantially truncated conical shape as in the above embodiments, a latching member 64 whose large diameter part is attached facing outward, rather than on the adapter 3 side, may be used, as shown in FIG. 6.

Here again, just as in the above embodiments, a bottom part 64*b* on the small diameter side can be moved in and out of a concave portion 63*a* merely by rotating a substantially truncated conical latching member 64 around a rotational axis 64*a* inside a through-hole 62*b*. A C-ring 65 (anti-rotation member) is provided so that this latching member 64 will not rotate under vibration, impact, or the like.

Consequently, just as in the above embodiments, a tooth 62 can be easily switched between a latched state and an unlatched state with respect to an adapter 63, merely by rotating the latching member 64. Also, since the latching member 64 can be rotated from the large diameter side, a large rotational force can be obtained with a smaller force.

(B) In Embodiments 1 and 2 above, an example was given in which the through-hole 2*b* into which the latching member 4 was inserted was provided on only one side face of the main body part 2*a* of the tooth 2, but the present invention is not limited to this.

For example, through-holes into which latching members are inserted may be provided on both left and right side faces of the bucket tooth. In this case, the tooth can be latched to the adapter on both side faces of the bucket tooth by forming concave portions on both left and right side faces on the adapter side as well.

(C) In the above embodiments, an example was given in which the concave portion 3*a* on the adapter 3 side was formed to match the shape of part of the latching member 4, but the present invention is not limited to this.

For example, the concave portion on the adapter side may be a simple through-hole that passes through the insertion portion, or may be a concave portion formed along the width direction of the insertion portion.

In this case, the concave portion is in linear contact with part of the latching member, but the tooth can be latched so as not to move away from the adapter.

However, it is best for the concave portion to be formed to match the shape of the latching member as in Embodiments 1 and 2 above in terms of being able to form a latched state at both faces by forming the concave portion to match the shape of part of the latching member 4 that enters the concave portion, and being able to generate a local load that is exerted on the latching member.

The construction equipment bucket tooth assembly of the present invention has the effect of allowing bucket teeth to be fixed to an adapter with a simple configuration, without reducing the service life of parts, and therefore can be widely applied to attachment structures for various kinds of excavation tool.

The invention claimed is:

1. A bucket tooth assembly that is interchangeably mounted to an adapter provided to a distal end part of a bucket of a construction equipment, the bucket assembly comprising:

a bucket tooth having a cavity for inserting the adapter, a contact face inside the cavity that comes into contact with an outer face of the adapter so as to receive a load exerted during work, a side face having a triangular shape on an outer face of the bucket tooth, and a through-hole that is provided to the side face and communicates through to the adapter when the bucket tooth has been mounted to the adapter, the through-hole having a center axis; and a latching member fitted inside the through-hole and having a rotational axis disposed along a direction of the center axis and a bottom part provided to an end on a side of the adapter in an axial direction, the latching member being rotated around the rotational axis to switch between a first state in which the bottom part is held inside the through-hole and a second state in which the bottom part protrudes toward a concave portion on the side of the adapter, the latching member being arranged such that a length of a side face portion is in left and right asymmetry in a cross sectional view along the rotational axis.

2. The bucket tooth assembly according to claim 1, wherein the latching member has a shape of a part of a truncated cone formed by the rotational axis, and the shape of the part of a truncated cone is arranged such that a cut face, obtained by cutting diagonally to the rotational axis from above a periphery of a bottom face of the truncated cone, corresponds to the bottom part of the latching member.

3. The bucket tooth assembly according to claim 2, wherein the bucket tooth has an inner face that forms the cavity, and the bottom part of the latching member lies in the same plane as the inner face in the first state.

4. The bucket tooth assembly according to claim 1, wherein the rotational axis of the latching member is inclined outwardly toward a distal end of the bucket tooth from the cavity along a width direction of the bucket tooth.

5. The bucket tooth assembly according to claim 1, wherein the latching member has a tool insertion portion, into which is inserted a part of a tool used when the latching member is rotated around the rotational axis, at a position that is exposed to an outside in a state in which the latching member has been inserted into the through-hole.

6. The bucket tooth assembly according to claim 1, further comprising an anti-rotation member that stops rotation of the latching member.

7. A bucket for a construction equipment comprising:

a plurality of adapters provided to a distal end part of the bucket;

a plurality of bucket tooth assemblies respectively mounted to the adapters, each of the bucket tooth assemblies having a through-hole formed in a side face and passing through to the adapter, and a latching member that is inserted into the through-hole and allows switching by rotation between a first state in which a bottom part is held inside the through-hole and a second state in which the bottom part protrudes from the through-hole; and a plurality of concave portions respectively provided to the adapters at positions corresponding to the through-holes of the bucket tooth assemblies, forming truncated conical spaces along with the through-holes, each of the concave portions having a face corresponding to a curved face of the truncated cone at a distal end side of the bucket tooth assembly and a face corresponding to a bottom face on a large-diameter side of the truncated cone at a rear end side of the bucket tooth assembly, and the bucket tooth assemblies being latched to the bucket by fitting in the latching members in the truncated conical spaces of the concave portions in the second state.

* * * * *